US007069681B2

(12) United States Patent
Noble et al.

(10) Patent No.: US 7,069,681 B2
(45) Date of Patent: Jul. 4, 2006

(54) SLIDING SIGN

(75) Inventors: Myron C. Noble, South Bend, IN (US); Aaron C. Poot, Mishawaka, IN (US); Theodore W. Redinger, Sr., Argos, IN (US); John R. Erichsen, Granger, IN (US)

(73) Assignee: Valmont Industries, Inc., Valley, NE (US)

( * ) Notice: Subject to any disclaimer, the term of this patent is extended or adjusted under 35 U.S.C. 154(b) by 245 days.

(21) Appl. No.: 10/823,014

(22) Filed: Apr. 13, 2004

(65) Prior Publication Data

US 2005/0223608 A1 Oct. 13, 2005

(51) Int. Cl.
*G09F 9/22* (2006.01)
*G09F 7/00* (2006.01)
*E09F 9/00* (2006.01)

(52) U.S. Cl. ..... 40/612; 40/490

(58) Field of Classification Search ..... 40/611.07, 40/606.11, 606.02, 612, 491, 490, 524; 52/641, 52/645, 633

See application file for complete search history.

(56) References Cited

U.S. PATENT DOCUMENTS

| | | | | |
|---|---|---|---|---|
| 2,409,076 | A * | 10/1946 | Steinberger et al. | 40/606.15 |
| 2,765,554 | A * | 10/1956 | Anderson et al. | 40/612 |
| 3,236,481 | A * | 2/1966 | Howard | 248/475.1 |
| 4,543,905 | A * | 10/1985 | McKenney | 116/63 P |
| 4,718,563 | A * | 1/1988 | Ellgass | 212/343 |
| 6,367,750 | B1 * | 4/2002 | Ford | 248/208 |
| 2005/0102873 | A1 * | 5/2005 | Poot | 40/612 |

FOREIGN PATENT DOCUMENTS

FR 2671895 A1 * 7/1992

* cited by examiner

*Primary Examiner*—Cassandra Davis
(74) *Attorney, Agent, or Firm*—Thomte, Mazour & Niebergall; Dennis L. Thomte

(57) ABSTRACT

A sliding sign is movably mounted on an overhead truss which extends over a roadway. The sliding sign is mounted on rails connected to the top and bottom chords of the truss so that the sign may be moved from a position over the roadway to a position adjacent the shoulder of the roadway so that necessary maintenance may be performed on the sign without the need for lane closures of the roadway.

24 Claims, 5 Drawing Sheets

SLIDING SIGN

BACKGROUND OF THE INVENTION

1. Field of the Invention

This invention relates to a sliding sign and more particularly to a sliding sign which is mounted on an elevated truss which extends over a roadway. More particularly, the invention relates to a sliding sign which allows the sign to be selectively moved to one end of the truss to facilitate maintenance of the sign at the shoulder of the roadway.

2. Description of the Prior Art

Various types of trusses such as box trusses are extended over roadways in an elevated condition to support signs. If the signs require maintenance or replacement, traffic lanes must be closed to enable workers to gain access to the signs by the way of lift buckets, ladders, etc. Lane closures are not only dangerous but are costly.

SUMMARY OF THE INVENTION

A sliding sign is described which is mounted on a truss such as a box truss or the like extending over a roadway. The truss includes top and bottom chords which are interconnected by various truss members. A first elongated rail is secured to the top chord of the truss and a second elongated rail is secured to the bottom chord of the truss. A plurality of horizontally spaced-apart and vertically disposed beams are movably mounted on the first and second rails and support one or more signs at the front side thereof. Wheels having V-shaped peripheries are secured to the upper and lower ends of the sign supporting beams and roll upon the first and second rails, respectively. The wheels at the lower ends of the sign supporting beams transfer gravity and lateral loads to the bottom chord of the truss while the wheels at the upper end of the sign supporting beams transfer lateral loads to the top chord of the truss. The V-shaped peripheries of the wheels prevent the wheels from disengaging from the respective rails. A bidirectional motor with brake is connected to the sign supporting structure so that the sign supporting structure and the sign mounted thereon may be moved from a position over the roadway to a position at one end of the truss so that maintenance may be performed on the sign at the roadway shoulder thereby preventing traffic lane closures.

It is therefore a principal object of the invention to provide a sliding sign for an overhead roadway sign structure.

Another object of the invention is to provide an overhead sign structure for use over roadways wherein the sign supporting structure thereon may be moved from a position over the roadway to a position near the roadway shoulder to facilitate maintenance and/or replacement of the sign.

A further object of the invention is to provide a sliding sign for an overhead truss wherein lateral and gravity loads are transferred from the sign structure to the top and bottom chords of the truss structure.

Yet another object of the invention is to provide a sliding sign which incorporates wheels having V-shaped peripheries which not only tend to clean the rails upon which they are mounted but which also transfer loads to the chords of the structure.

Yet another object of the invention is to provide a sign structure of the type described which includes a bidirectional motor connected to the sliding sign to enable the sliding sign to be moved from a position over the roadway to a position adjacent the shoulder of the roadway.

Still another object of the invention is to provide a sliding sign structure which may be easily mounted on an existing overhead truss without extensive modification thereof.

These and other objects will be obvious to those skilled in the art.

DETAILED DESCRIPTION OF THE INVENTION

Figure 1:
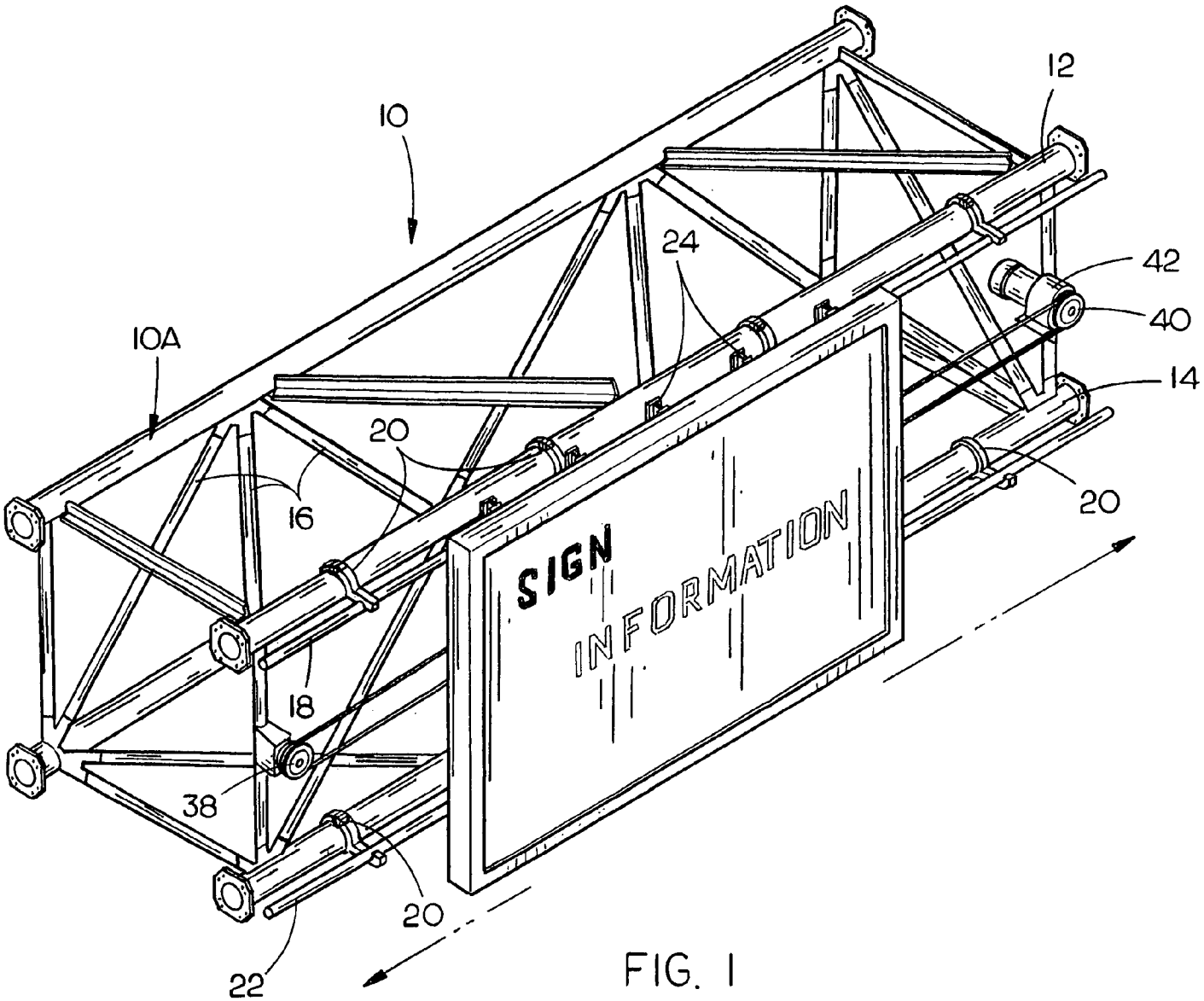
FIG. 1 is a partial perspective view of a box beam truss having the sliding sign structure of this invention mounted thereon.

The numeral 10 refers to a truss which extends over a roadway for supporting one or more sign structures thereon. Although most of the sign supporting trusses are of the box beam truss construction as shown in the drawings, other types of truss structures are also employed. Regardless of the truss structure, the structure will include a top chord 12 and a bottom chord 14 which face the direction of traffic. If a box beam truss structure is employed, a pair of top chords and a pair of bottom chords are employed, as illustrated in FIG. 1. The chords are interconnected in conventional fashion by truss members 16. Normally, the truss 10 is comprised of a plurality of truss sections 10A which are bolted together in an end-to-end fashion. The truss 10 is supported at its opposite ends by upstanding supports in conventional fashion so as to extend over the roadway.

Normally, a sign structure 17 will be supported on the truss over the roadway. If maintenance or replacement of the sign structure is required, one or more traffic lanes beneath the sign structure must be closed to enable workers to gain access to the sign structures by lift buckets, ladders, etc. The instant invention eliminates the need for lane closures when sign maintenance/replacement is required.

A first elongated rail or tube 18 is secured to the top chord 12 by clamps 20 or any other convenient means. The rail 18 extends from the shoulder end of the truss to a point over the roadway. A second elongated rail 22 is secured to the bottom chord 14 by clamps 20 or any other convenient means. The rail 22 also extends from the shoulder end of the truss to a point over the roadway.

Figure 5:
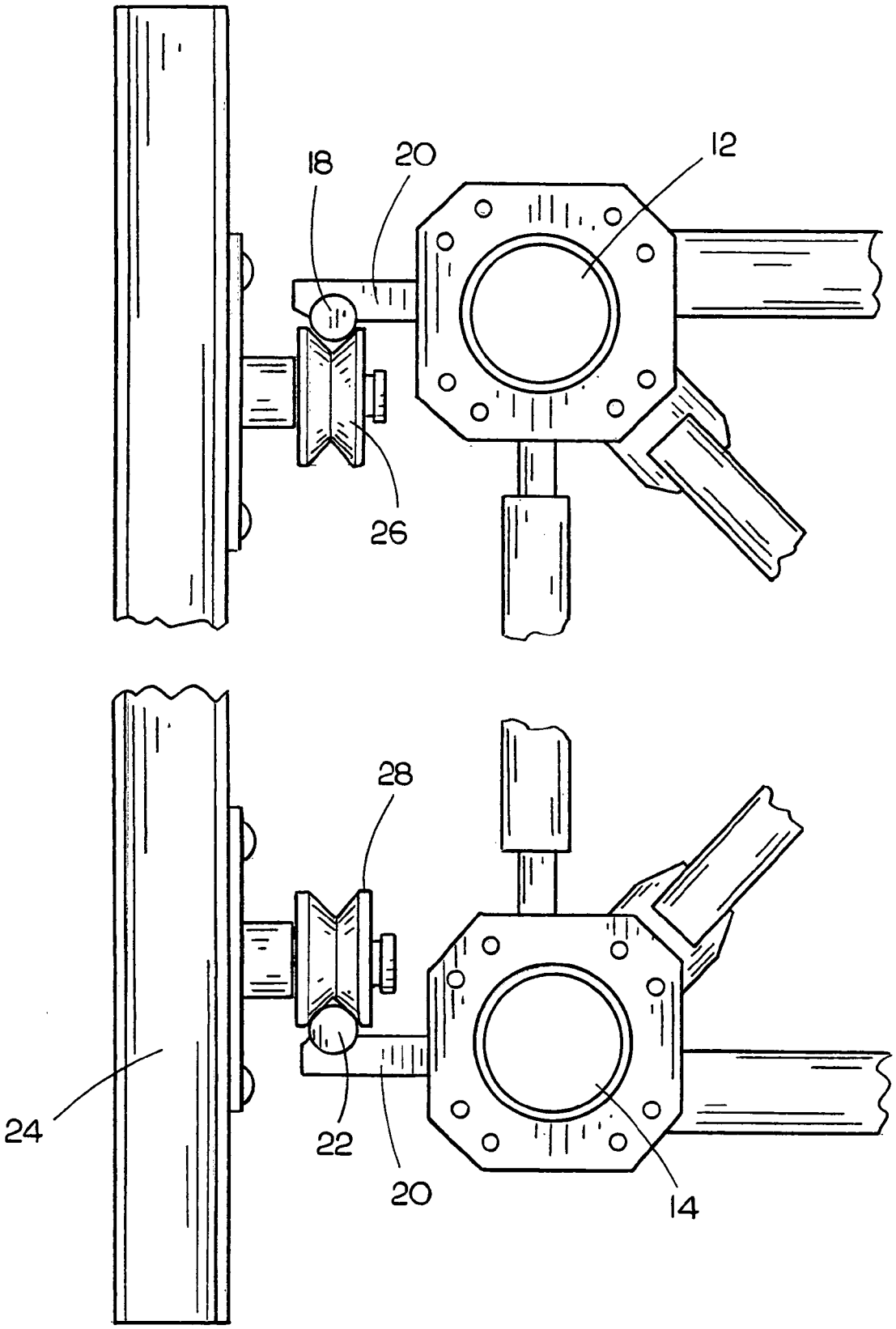
FIG. 5 is a partial end view of the sliding sign structure of this invention.

Vertically disposed and horizontally spaced sign supporting beams 24 are positioned between the chords 12 and 14 and have wheels or rollers 26 mounted thereon at the upper end thereof and wheels or rollers 28 mounted thereon at the lower end thereof. Preferably, the wheels 26 and 28 have generally V-shaped peripheries which engage the rails 18 and 22, respectively, as seen in FIG. 5. Sign structure 17 is secured to the beams 24. The wheels 28 transfer gravity and lateral loads into the bottom chord 14 while wheels 26 transfer lateral loads into the top chord 12. The V-shaped peripheries of the wheels 26 and 28 prevent the wheels 26 and 28 from disengaging from the rails 18 and 22, respectively. Wheels 28 ride upon rail 22 and tend to clean the rail as they pass thereover. Wheels 26 engage rails 18 but have a certain amount of "play" therebetween. Thus, sign structure 17 may be selectively moved along rails 18 and 22 from a position over the roadway to a position adjacent the shoulder of the roadway to enable maintenance and/or repair of the sign structure safely from the roadway shoulder without the necessity of lane closures.

Figure 2:
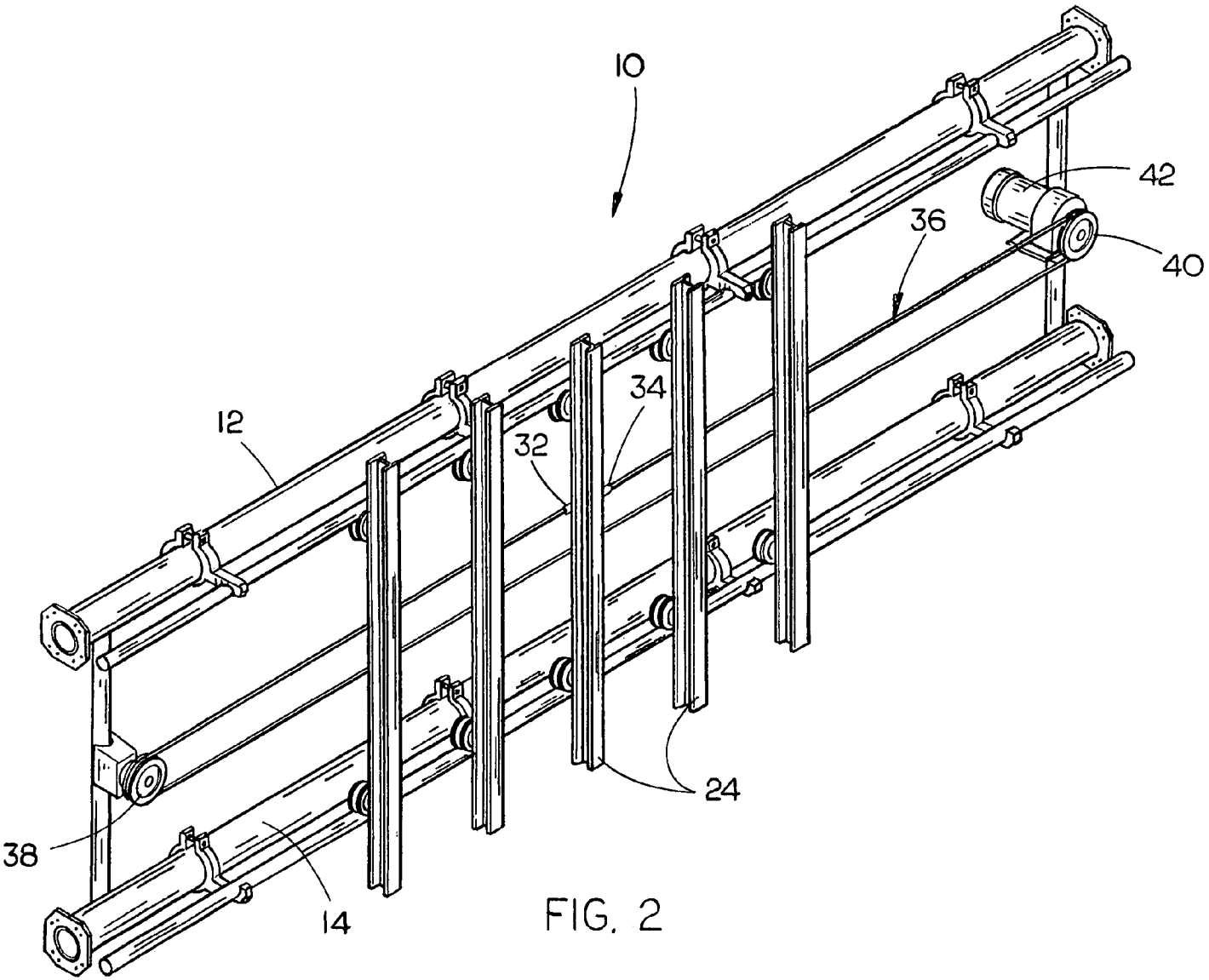
FIG. 2 is a partial perspective view of the sliding sign structure of this invention.
Figure 3:
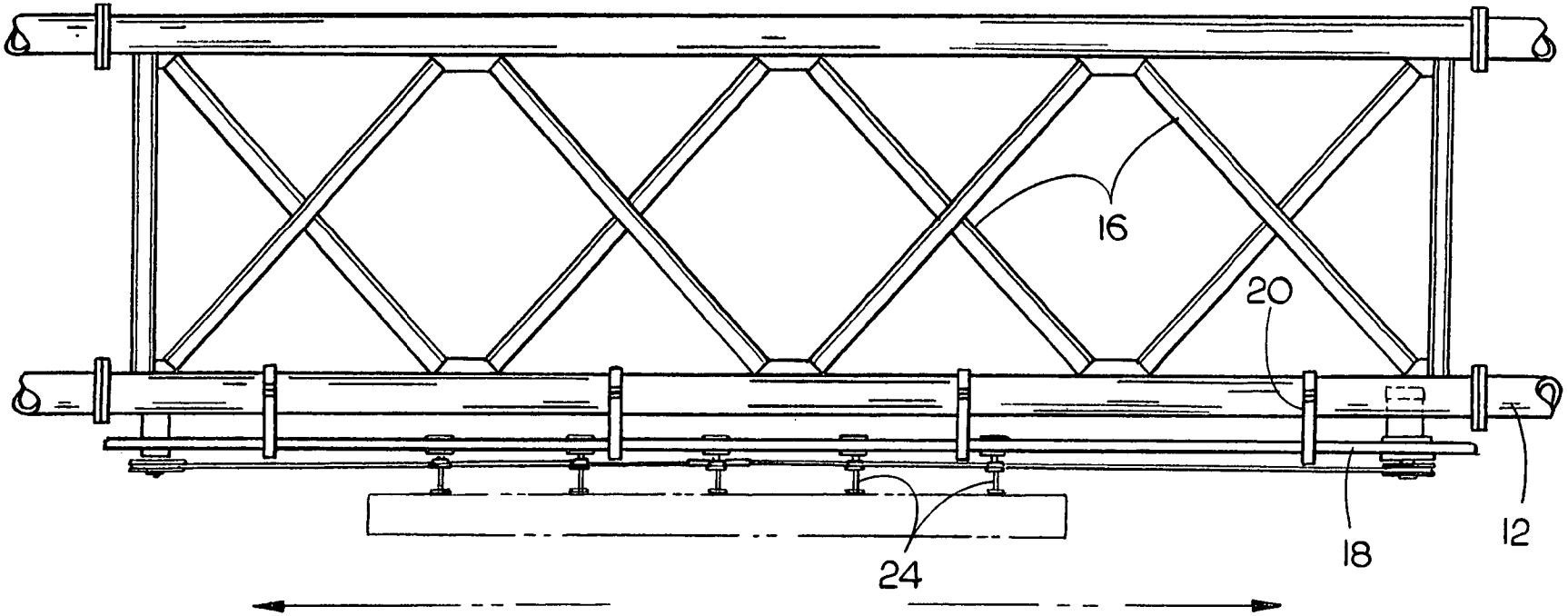
FIG. 3 is a top view of the sliding sign structure of this invention.
Figure 4:
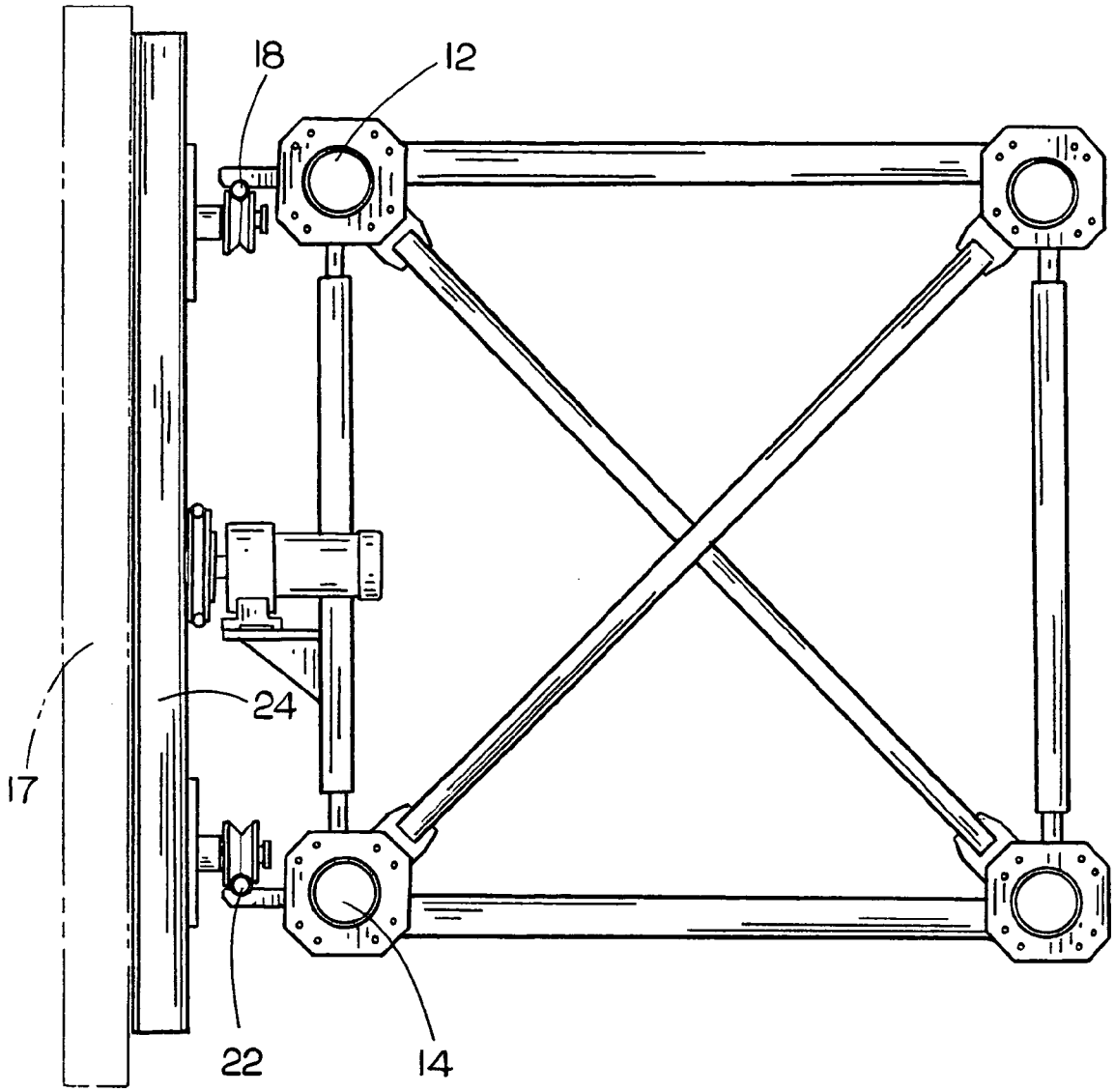
FIG. 4 is an end view of the sliding sign structure of this invention.

Many different types of mechanisms may be provided for moving the sign structure along the rails 18 and 22. A preferred embodiment is illustrated in FIG. 2. As seen in FIG. 2, the ends 32 and 34 of a cable 36 are tied off or connected to one of the beams 24. Cable 36 extends around end pulley 38 which is rotatably mounted on the truss 10. Cable 36 also extends around a front or drive pulley 40 which is mounted on the power shaft of a bidirectional motor 42 which is also secured to the truss 10. Motor 42 includes a conventional brake which prevents rotation of pulley 40 unless motor 42 is energized.

Motor 42 may be operated in one direction to move the beams 24 and sign structure 17 from a position over the roadway to a position adjacent the shoulder of the roadway and vice versa. The brake on the motor 42 prevents the sign structure from moving until the motor 42 is activated.

Thus, it can be seen that the invention accomplishes at least all of its stated objectives.

We claim:

1. In combination:

an elevated truss extending over a roadway and having opposite ends;

said truss including top and bottom chords having opposite ends;

a first elongated rail secured to said top chord which extends from adjacent one end of said top chord towards the other end of said top chord;

a second elongated rail secured to said bottom chord which extends from adjacent one end of said bottom chord towards the other end of said bottom chord;

and a sign support structure movably mounted on said first and second rails;

said sign support structure being selectively movable from a first position over the roadway to a second position adjacent the shoulder of the roadway.

2. The combination of claim 1 wherein a motorized cable system is connected to said sign support structure to selectively move said sign support structure on said first and second rails.

3. The combination of claim 1 wherein said sign support structure includes a plurality of horizontally spaced-apart and vertically disposed beams having upper and lower ends; at least some of said beams having rail engaging members thereon which movably engage said first and second rails.

4. The combination of claim 3 wherein said second rail and said rail engaging members cooperate to cause lateral and gravity forces to be passed into said bottom chord; said first rail and said rail engaging members cooperating to cause lateral loads to be passed into said top chord.

5. The combination of claim 3 wherein said rail engaging members comprise wheels.

6. The combination of claim 5 wherein said wheels have recessed peripheries which engage said rails.

7. The combination of claim 6 wherein said recessed peripheries are substantially V-shaped in section.

8. The combination of claim 7 wherein each of said rails comprises a tube.

9. The combination of claim 1 wherein each of said rails comprises a tube.

10. The combination of claim 1 wherein said elevated truss comprises a box truss structure.

11. A sign support for use with an elevated truss extending over a roadway, the truss having opposite ends secured to upstanding supports, the truss also including top and bottom chords having opposite ends; the sign support structure comprising:

a first elongated rail secured to the top chord which extends from adjacent one end of the top chord towards the other end of the top chord;

a second elongated rail secured to the bottom chord which extends from adjacent one end of the bottom chord towards the other end of the bottom chord;

and a sign support structure movably mounted on said first and second rails;

said sign support structure being selectively movable from a first position over the roadway to a second position adjacent the shoulder of the roadway.

12. The sign structure of claim 11 wherein a motorized cable system is connected to said sign support structure to selectively move said sign support structure on said first and second rails.

13. The sign structure of claim 11 wherein said sign support structure includes a plurality of horizontally spaced-apart vertically disposed beams having upper and lower ends; at least some of said beams having rail engaging members thereon which movably engage said first and second rails.

14. The sign structure of claim 13 wherein said second rail and said rail engaging members cooperate to cause lateral and gravity forces to be passed into said bottom chord; said first rail and said rail engaging members cooperating to cause lateral loads to be passed into said top chord.

15. The sign structure of claim 13 wherein said rail engaging members comprise wheels.

16. The sign structure of claim 15 wherein said wheels have recessed peripheries which engage said rails.

17. The sign structure of claim 16 wherein said recessed peripheries are substantially V-shaped.

18. The sign structure of claim 17 wherein each of said rails comprises a tube.

19. The sign structure of claim 11 wherein each of said rails comprises a tube.

20. The sign structure of claim 11 wherein said elevated truss comprises a box truss structure.

21. In combination:

an elevated truss extending over a roadway and having opposite ends;

said truss including top and bottom chords having opposite ends;

a first elongated rail secured to said top chord which extends from adjacent one end of said top chord towards the other end of said top chord;

a second elongated rail secured to said bottom chord which extends from adjacent one end of said bottom chord towards the other end of said bottom chord;

and a support structure movably mounted on said first and second rails;

said support structure being selectively movable from a first position over the roadway to a second position adjacent the shoulder of the roadway.

22. The combination of claim 21 wherein a motorized cable system is connected to said support structure to selectively move said support structure on said first and second rails.

23. The combination of claim 21 wherein said support structure includes a plurality of horizontally spaced-apart and vertically disposed beams having upper and lower ends;

at least some of said beams having rail engaging members thereon which movably engage said first and second rails.

24. A support for use with an elevated truss extending over a roadway, the truss having opposite ends secured to upstanding supports, the truss also including top and bottom chords having opposite ends; the support structure comprising:

a first elongated rail secured to the top chord which extends from adjacent one end of the top chord towards the other end of the top chord;

a second elongated rail secured to the bottom chord which extends from adjacent one end of the bottom chord towards the other end of the bottom chord;

and a support structure movably mounted on said first and second rails;

said support structure being selectively movable from a first position over the roadway to a second position adjacent the shoulder of the roadway.

* * * * *